US007155154B2

(12) United States Patent
Uehara et al.

(10) Patent No.: US 7,155,154 B2
(45) Date of Patent: Dec. 26, 2006

(54) FIXING DEVICE AND IMAGE FORMING DEVICE

(75) Inventors: Yasuhiro Uehara, Nakai-machi (JP); Motofumi Baba, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 134 days.

(21) Appl. No.: 10/816,912

(22) Filed: Apr. 5, 2004

(65) Prior Publication Data

US 2005/0047838 A1 Mar. 3, 2005

(30) Foreign Application Priority Data

Sep. 1, 2003 (JP) ..... 2003-308972

(51) Int. Cl.
*G03G 15/20* (2006.01)

(52) U.S. Cl. ..... 399/329

(58) Field of Classification Search ..... 399/320, 399/328–331, 335; 219/216
See application file for complete search history.

(56) References Cited

U.S. PATENT DOCUMENTS 5,729,812 A * 3/1998 Moser ..... 399/329
6,795,678 B1 * 9/2004 Yura et al. ..... 399/329
6,895,206 B1 * 5/2005 Nakamura et al. ..... 399/328
2002/0009306 A1 * 1/2002 Hayashi et al. ..... 399/69

FOREIGN PATENT DOCUMENTS

JP 02210480 A * 8/1990
JP 5-150679 6/1993
JP 8-262903 10/1996
JP 11-7216 1/1999

* cited by examiner

*Primary Examiner*—David M. Gray
*Assistant Examiner*—Ryan Gleitz
(74) *Attorney, Agent, or Firm*—Morgan, Lewis & Bockius, LLP

(57) ABSTRACT

A fixing device including a fixing belt module is formed of a fixing roller having a heat source, one or more tension rollers at a fixing side and an endless fixing belt looped and stretched around the rollers to thereby rotate and a pressure belt module including an endless pressure belt that comes in contact with an outer peripheral surface of the fixing belt only within a range of a section where the fixing belt is wrapped around a surface of the fixing roller, thereby forming a nip section for fixation between itself and the fixing belt. The fixing belt module includes a fixing belt heating unit that heats an inner peripheral surface and/or the outer peripheral surface of the fixing belt at any sections other than the section where the fixing belt is wrapped around the outer peripheral surface of the fixing roller.

11 Claims, 7 Drawing Sheets

FIXING DEVICE AND IMAGE FORMING DEVICE

BACKGROUND OF THE INVENTION

1. Field of the Invention

The present invention relates to a fixing device, in an image information recording device such as a copying machine, printer and facsimile, for heat-fixing an unfixed toner image onto a surface of a recording medium such as a recording sheet, and more particularly to a fixing device of a belt-nip system using a belt for forming a nip section for fixation. Further, the present invention relates to an image forming device including this fixing device.

2. Description of the Related Art

A so-called heat-pressure roller fixing device has widely been used as a conventional fixing device wherein an unfixed toner image is passed through a press-contact region between a pair of heated rollers to thereby fix the unfixed toner image (hereinafter referred to as "roll-nip system"). FIG. 5 shows a cross-sectional view of a roll-nip type fixing device. In FIG. 5, numeral 101 denotes a fixing roller rotating in a direction shown by an arrow F, while 106 denotes a pressure roller rotating in a direction shown by an arrow G with the fixing roller 101.

The fixing roller 101 is formed to have a silicon rubber coated as an elastic layer 104 on a surface of a hollow layer 105 made of a metal having high heat conductivity such as aluminum, and further have coated thereon a coating layer 103 made of Teflon (R) having releasability. A halogen lamp 102 is arranged as a heat source in the hollow roller 105. The halogen lamp 102 is on/off-controlled by a temperature controlling circuit not shown based upon a signal from a temperature sensor 108 disposed on the surface of the fixing roller 101, thereby adjusting the surface of the fixing roller 101 to have a desired constant temperature.

On the other hand, the pressure roller 106 is formed to have a relatively thick heat-resistant elastic layer 110 such as a silicon rubber coated on a mandrel roller 109. The elastic deformation of the heat-resistant elastic layer 110 forms a press-contact section (nip section) N' of the fixing roller 101 and the pressure roller 106.

A sheet P having an unfixed toner image T formed thereon advances in the direction shown by an arrow H to be inserted into the nip section N', whereby the unfixed toner image T is fixed by an action of pressure and thermal energy. Since the sheet P passing through the nip section N' is liable to wrap around the fixing roller 101 due to the adherence of toner, a separation pawl 107 is disposed for separating the sheet P. Disposing the separation pawl 107 allows to separate the sheet P subject to the fixing operation from the fixing roller 101, whereby the sheet P is discharged from the device.

However, in the case where a high-speed fixing is intended by use of the above mentioned fixing system, it is necessary to give thermal energy and pressure sufficient to perform the fixing operation to the unfixed toner image T and the sheet P. This needs to widen the nip section N' (nip width) in proportion to the fixing speed. In order to widen the nip section, there are various methods including a method for increasing a load between the rollers 101 and 106, a method for increasing a thickness of the elastic layer 104 or a thickness of the heat-resistant elastic layer 110, a method for increasing the diameters of both rollers 101 and 106, and the like.

The method for increasing the load between both rollers or the method for increasing the thickness of the elastic layer entails non-uniformness in the shape of the nip width along the shaft of the roller that is caused by a bending of the roller, non-uniform fixing or wrinkle on the sheet, thus having a limitation. Further, the method for increasing the diameter of the roller has no problem in quality as described above, but entails a problem that the device is large-sized and that the time for rising the temperature of the fixing roller 101 from room temperature to a fixable temperature (generally referred to as "warm-up time") is prolonged.

In order to solve these problems to cope with a more high-speed operation, a system using a belt has been proposed as shown in FIG. 2 in the Patent Reference 1 (the system using a belt for forming the nip section is referred to as "belt-nip system" hereinafter). FIG. 6 shows a cross-sectional view of a fixing device of such a belt-nip system.

The fixing device shown in FIG. 6 has a main section formed of a fixing roller 111 rotating in a direction shown by an arrow J and a pressure belt module 116. The pressure belt module 116 has a main section formed of an endless belt 131 looped and stretched around three rollers of an inlet roller 128, pressure roller 129 and a tension roller 130 and a pressure pad (pressure member) 127 that is pressed against the fixing roller 111 via the endless belt 131.

The endless belt 131 rotates in a direction shown by an arrow K and forms a nip section N" by being in contact with the fixing roller 111 such that the area between the inlet roller 128 and the pressure roller 129 wraps around the fixing roller 111. The pressure pad 127 is arranged in the endless belt 131 so as to be pressed against the fixing roller 111 via the endless belt 131. The pressure roller 128 is urged toward the surface of the fixing roller 111 via the endless belt 131 at the most downstream side with respect to the nip section N" in the rotating direction (in a direction shown by an arrow K) of the endless belt 131, thereby forming a terminal end of the nip section.

Like the fixing roller 101 in the fixing device of a roll-nip system shown in FIG. 5, the fixing roller 111 is formed to have a silicon rubber coated as an elastic layer 114 on a surface of a hollow layer 115, and further have coated thereon a coating layer 113. A halogen lamp 112 is arranged as a heat source in the hollow roller 115.

In the fixing device of a belt-nip system shown in FIG. 6, a sheet 127 having an unfixed toner image 126 formed thereon is inserted into the nip section, whereby the unfixed toner image 126 is fixed by pressure and thermal energy at the nip section. This configuration can easily widen the nip width between the endless belt 131 and the fixing roller 111 compared to the nip width in a conventional roll-nip system (can form a wide nip), whereby it is possible to cope with a high-speed operation. Further, this configuration can attain a small-sized device than the fixing device of a roll-nip system when compared to each other with the same fixing speed.

However, there is a limitation to cope with the high-speed operation even in the fixing device of such a belt-nip system. Although the belt-nip fixing device can form a wide nip, there may be a case where, when a great number of sheets are intended to be subject to a fixing operation during a short period with high speed, the surface temperature of the fixing roller 111 temporarily reduces to thereby cause defective fixing when a number of copied sheets exceeds some numbers. This phenomenon is referred to as a temperature droop. This is a phenomenon caused by the following. Specifically, the silicon rubber coated as the elastic layer on the core of the fixing roller 11 serves as a thermal resistance, so that the heat is not rapidly transmitted to the surface of the fixing roller even if sufficient heat quantity is given to the inside of the roller. The temperature droop becomes great particularly when a thick paper having a great heat capacity is used. When the temperature droop occurs, it is impossible to give sufficient heat quantity to the sheet even if the wide nip is formed, whereby the merit of the belt-nip system cannot sufficiently be utilized.

A system for simultaneously using an external heating has been proposed (see the Patent Reference 2, for example) in order to improve this temperature droop. FIG. 7 shows a cross-sectional view of a fixing device of a belt-nip system and using an external heating. Although the fixing device shown in FIG. 7 is basically the same as the fixing device shown in FIG. 6, it has an external heating roller 132 mounted thereto that comes in contact with the surface of the fixing roller 111 for heating the fixing roller 111 not only from its inside but also from its outside by utilizing a heat source arranged in the external heating roller 132. However, since the contact width of the external heating roller 132 and the fixing roller 11 is narrow, the thermal energy of the external heating roller 132 cannot sufficiently be given to the fixing roller 111, with the result that it is difficult to obtain an effect as expected by simultaneously using the external heating. Further, heat radiation from the external heating roller 132 becomes great, so that it is desired to be improved from the viewpoint of efficiency of use of energy.

As the belt-nip system, not an embodiment wherein the belt at the pressure side is stretched as explained above, but a so-called free-belt-nip system has been proposed (see the Patent Reference 3, for example) wherein the belt is free and comes in contact with the fixing roller at the fixing side with the belt being rotatable with the fixing roller. This configuration has a merit of the belt-nip system and also entails the problem of the temperature droop involved with the high-speed operation and the problem of the efficiency of use of energy as described above, like the embodiment wherein the belt at the pressure side is stretched as explained above. Accordingly, the "belt-nip system" means here a concept including the "free-belt-nip system".

[Patent Reference 1]

Japanese Published Unexamined Patent Application No. Hei 5-150679

[Patent Reference 2]

Japanese Published Unexamined Patent Application No. Hei 11-7216

[Patent Reference 3]

Japanese Published Unexamined Patent Application No. Hei 8-262903

SUMMARY OF THE INVENTION

The present invention aims to solve the abovementioned problems, and to provide a fixing device capable of effectively suppressing the occurrence of a temperature droop in order to implement a high-speed fixability at a higher level by a merit of a belt-nip fixing device, i.e., by assuring a wide nip and to provide an image forming device including this fixing device.

The above mentioned aim can be accomplished by the invention described below. Specifically, a fixing device of the present invention includes a fixing belt module formed of a fixing roller having a heat source, one or more tension rollers at a fixing side and an endless fixing belt looped and stretched around the rollers to thereby rotate and a pressure belt module including an endless pressure belt that comes in contact with an outer peripheral surface of the fixing belt only within a range of a section where the fixing belt is wrapped around a surface of the fixing roller, thereby forming a nip section for fixation between itself and the fixing belt, wherein the fixing belt module includes a fixing belt heating unit that heats an inner peripheral surface and/or the outer peripheral surface of the fixing belt at any sections other than the section where the fixing belt is wrapped around the outer peripheral surface of the fixing roller.

Specifically, the fixing device of the present invention is characterized by including the fixing belt and the fixing belt heating unit in addition to the configuration at the fixing roller side in the conventional belt-nip fixing device as mentioned above.

Specifically, the belt-nip fixing device utilizes the nip section formed between the belt at the pressing side and the fixing roller for the fixing operation. It is one of the features of the present invention that a part of the fixing belt is wrapped (filmed) around the surface of the fixing roller for forming the nip section between the fixing belt and the belt at the pressing side. From this viewpoint, the fixing device of the present invention can be called as a two-belt system.

The fixing belt is partly wrapped around the surface of the fixing roller, with which the pressure belt is conventionally in contact, and stretched by another roller (fixing-side tension roller). Its inner peripheral surface and/or outer peripheral surface is heated by a fixing belt heating unit at a position apart from the fixing roller. Examples of the fixing belt include a configuration having fluoro resin coated as a release layer on a flexible base layer, a configuration having a thin silicon rubber layer provided as an elastic layer between the base layer and the release layer, and the like.

BRIEF DESCRIPTION OF THE DRAWINGS

Preferred embodiments of the present invention will be described in detail based on the following figures, wherein.

DESCRIPTION OF THE PREFERRED EMBODIMENT

[Fixing Device]

The present invention will be explained in detail by taking three embodiments.

<First Embodiment>

Figure 1:
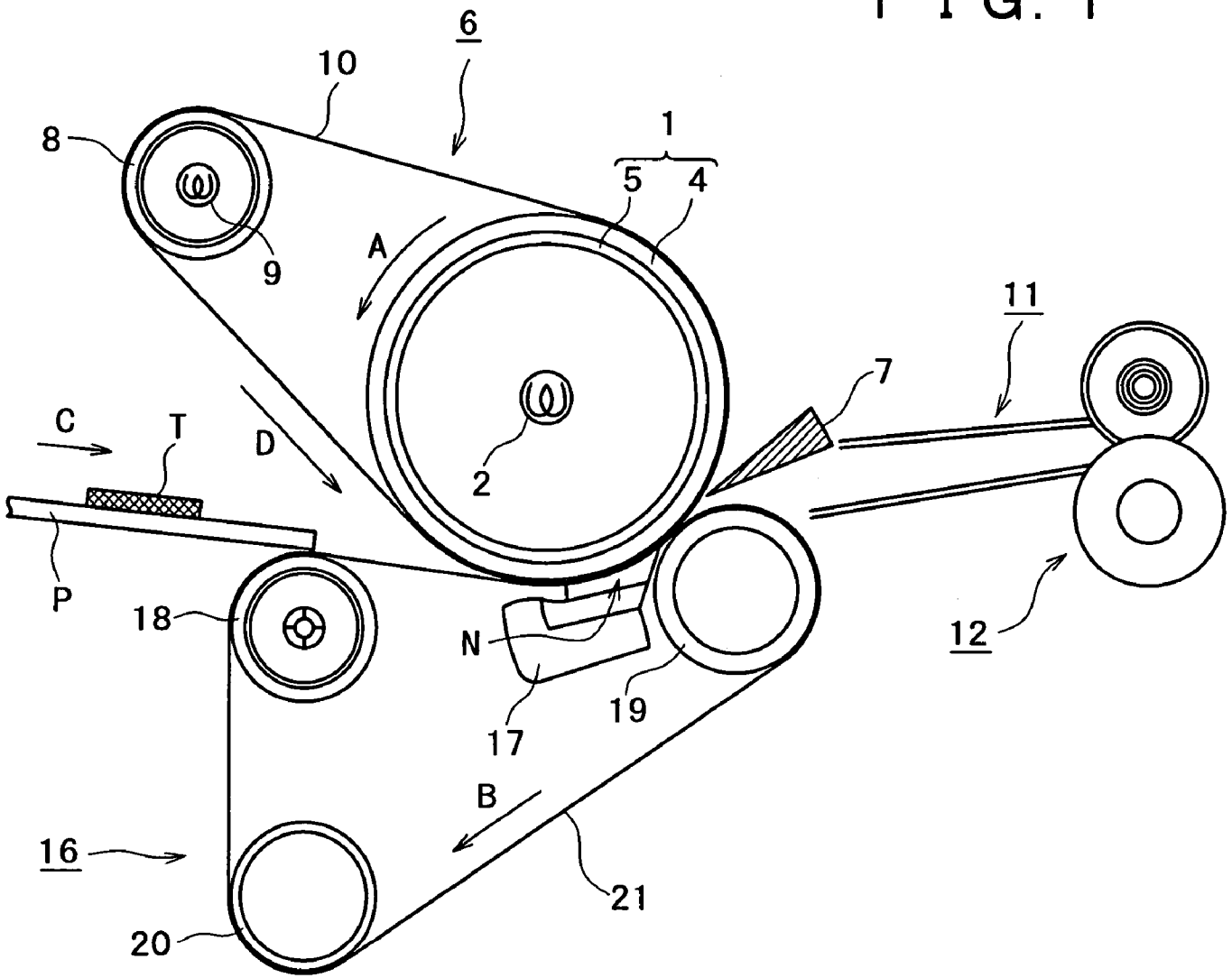
FIG. 1 is a cross-sectional view of a fixing device of a first embodiment that is one example of the present invention.

Firstly, the first embodiment is illustrated as an example of the embodiment A of the present invention. FIG. 1 is a cross-sectional view of a fixing device that is one example of the embodiment A (stretch-type) of the present invention according to the first embodiment. The fixing device of this embodiment is formed of a fixing belt module 6, a pressure belt module 16, a separation guide plate 7 and sheet discharge mechanisms (11, 12).

The fixing belt module 6 is formed of a fixing roller 1 rotating in a direction shown by an arrow A, a tension roller (fixing-side tension roller) 8 having a halogen lamp 9 disposed therein as a heat source and a fixing belt 10 that is looped to be stretched around the fixing roller 1 and the tension roller 8 and rotates with these rollers in a direction shown by an arrow D.

The fixing roller 1 is made of an aluminum and having an elastic layer 4 of 1.5-mm thick coated on the surface of a core 5 of 5-mm thick. A halogen lamp 2 is disposed in the fixing roller 1 as a heat source. In this embodiment, a silicon LSR (Liquid Silicone Rubber) rubber having a rubber hardness of 25 to 45° is used as the elastic layer. The fixing roller is a soft roller having an outer diameter of 65 mmϕ and a length of 350 mm in this embodiment.

The material of the elastic layer 4 is not limited to the silicon rubber, and various materials conventionally known can be used. For example, a fluoro rubber can be used, so that an elastic layer having plural layers laminated made of the silicon rubber and fluoro rubber may be used. Further, a so-called hard roller having no elasticity may be used as the fixing roller 1. The fixing roller 1 rotates in the direction A at a surface speed of 400 mm per second. The halogen lamp 2 of 1000 W is inserted into the fixing roller 1, whereby the surface of the fixing roller 1 is controlled to have a temperature of 160° C. by a temperature sensor and a temperature controller not shown.

The fixing belt 10 is stretched around the fixing roller 1 whose inside is heated and the tension roller 8 with a tension force of 10 kg. The fixing belt 10 is a flexible endless belt having a peripheral length of 330 mm and a width of 340 mm. The fixing belt 10 has a multi-layered structure having an elastic layer made of a silicon rubber of 200-μm thick formed on the surface (outer peripheral surface) of a base layer made of a polyimide of 75-μm thick, and further having a surface layer coated thereon made of a tetrafluoroethylene-perfluoroalkyl vinyl ether copolymer (PFA) of 30-μm thick. The silicon rubber of the elastic layer has a rubber hardness of 20 degrees (JIS-A) and is provided for improving an image quality of a color image in particular. It is needless to say that the configuration of the fixing belt 10 is not limited to the abovementioned one in the present invention. The condition of material, thickness, hardness and the like may suitably be selected according to a device design such as an object for use, condition upon using and the like.

The tension roller 8 has a base material made of a stainless pipe roller having a diameter of 23 mm, thickness of 2 mm and length of 350 mm. A 20-μm thick PFA is coated on the surface of the base to form a release layer. This release layer is to prevent a slight offset toner or sheet particle from the surface of the fixing belt from accumulating on a second heating roller.

A halogen lamp 9 of 800 W is inserted into the tension roller 8, whereby the surface of the tension roller 8 is controlled to have a temperature of 200° C. by a temperature sensor and a temperature controller not shown. Accordingly, the tension roller 8 has not only a function as a fixing-side tension roller but also a function of fixing belt heating unit.

Moreover, the tension roller 8 has a so-called arched shape wherein its diameter at the center is greater than the diameter at the end section by 100 μm, in order to reduce as much as possible the shift of the fixing belt 10 in the shaft direction and to stretch the fixing belt 10 uniformly.

The main part of the pressure belt module 16 is formed of a pressure belt 21 looped and stretched by three rollers of a reed roller (pressing-side tension roller) 18, a pressure roller 19 and a tension roller (fixing-side tension roller) 20 and a pressure pad (pressure member) 17 pressed toward the fixing roller 1 via the belt 21.

The pressure belt 21 comes in contact with the outer peripheral surface of the fixing belt 10 wrapped around the fixing roller 1 so as to be wrapped around the fixing roller 1 at a predetermined angle, thereby forming a nip section N. This nip section N is formed at the region where the fixing belt 10 is wrapped around the fixing roller 1, whereby it seems as if the sheet P having the unfixed toner formed thereon is roller-fixed by the fixing roller 1 having the fixing belt 10 wrapped around its outer peripheral surface when the sheet P passes through the nip section N.

The pressure pad (pressure member) 17 is arranged at the inside of the pressure belt 21 so as to be urged against the fixing roller 1 via the pressure belt 21. In this embodiment, the wrap angle of the pressure belt 21 to the fixing roller 1 is 45 degrees (the nip width of the entire nip section N is 26 mm).

The pressure belt 21 is preferably formed of a base layer and a release layer coated on the surface (the surface that is in contact with the fixing roller 1 or both surfaces) of the base layer. The base layer is made of polyimide, polyamide, polyamideimide and the like, and its thickness is preferably about 50 to 125 μm, and more preferably about 75 to 100 μm. The release layer formed on the surface of the base layer is preferably made of fluoro resin, for example, PFA and the like coated with a thickness of 5 to 20 μm as described above.

This embodiment uses, as the pressure belt 21, a belt formed only of a base layer made of a polyimide film having a thickness of 75 μm, width of 300 mm and peripheral length of 288 mm. The pressure belt 21 is stretched by three stainless rollers, i.e., the reed roller 18, pressure roller 19 and the tension roller 20, with tension force of 10 kg. Each of three rollers has a diameter of 22 mm, 20 mm and 20 mm respectively.

The pressure pad 17 serving as the pressure member has, for example, an elastic member for securing a wide nip section N and a low-friction layer formed on the surface of the pressure belt 21 that is in contact with the inner peripheral surface of the pressure belt 21. The pressure pad 17 is held by a holder made of a metal and the like. The elastic member having the low-friction layer formed on its surface has a concave section approximately along the outer peripheral surface of the fixing roller 1, thereby forming the nip section N by being pressed toward the fixing roller 1.

A usable elastic member of the pressure pad 17 includes an elastic member having high heat-resistance such as a silicon rubber, fluoro rubber and the like or a leaf spring. The low-friction layer formed on the elastic member is disposed for reducing sliding resistance between the inner peripheral surface of the pressure belt 21 and the pressure pad 17, and preferably has a small coefficient of friction and abrasion resistance. Specifically, a glass fiber sheet in which Teflon (R) is impregnated, fluororesin sheet, fluororesin coating film and the like can be used.

In addition to the one that is formed into a pad shape like the present embodiment, the one that is formed into a roll shape can be used, as the pressure member, to be urged against the surface of the fixing roller 1 via the pressure belt 21 for rotating therewith. It is needless to say that the pressure member formed into a pad shape in this embodiment is preferable, since it can afford widely and uniformly nip pressure over the entire nip section that is brought into contact with the pressure member.

Moreover, the pressure roller 19 at the downstream side of the pressure pad 17 with respect to the transporting direction of the sheet P is urged toward the center of the fixing roller 1 by a compression spring (not shown) as a pressing unit via the pressure belt 21 and the fixing belt 10, thereby producing a constant distortion amount at the corresponding section of the fixing roller 1 and the fixing belt 10. Specifically, the elastic layer 4 on the surface of the fixing roller 1 and the elastic layer of the fixing belt 10 are elastically deformed and distortion is caused on its surface. In order to effectively transmit the distortion of the fixing roller 1 with low load, it is desirable that the pressure roller 19 has a diameter smaller than that of the fixing roller 1 and has a hard surface. Accordingly, the releasability of the sheet P is secured at the outlet of the nip section N due to the distortion of the fixing roller 1.

The pressure belt 21 circularly moves in the direction shown by an arrow B with the rotation of the fixing roller 1 in the direction A. Its advancing speed is 400 mm/sec that is equal to the surface speed of the fixing roller 1.

The specific state of the fixation to the sheet P by the fixing device of this embodiment will be explained.

The sheet P having the unfixed toner image T formed thereon is transported toward the nip section N (in a direction shown by an arrow C) from the left side in FIG. 1. The unfixed toner image T on the sheet P that is inserted to the nip section N is fixed by pressure and heat caused at the nip section N. Fixing by use of the fixing device of the present embodiment can assure stable fixability since a wide nip section can be obtained.

In this case, two types of heat is caused at the nip section N, i.e., given to the fixing belt 10; heat given by the halogen lamp 2 through the fixing roller 1, that is similar to the conventional case, and heat directly given to the fixing belt 10 by the tension roller 8 heated by the halogen lamp 9 and serving as the fixing belt heating unit. Energy supply that cannot be provided only by the former heat can suitably and rapidly be supplied by the latter heat.

As already described above, the pressure roller 19 is pressed toward the fixing roller 1 at the outlet of the nip section N, thereby providing a distortion to the elastic layer 4 of the fixing roller 1. This configuration can secure the nip section N and locally increases the distortion of the fixing roller 1 at the vicinity of the outlet of the nip section N.

A separation guide plate 7 is disposed at the downstream side in the rotating direction A of the fixing roller 1 from the nip section N at the fixing roller 1, such that one side thereof is in proximate contact with the vicinity of the surface of the fixing roller 1 and it is laid in the rotating direction A of the fixing roller 1.

The sheet P separated from the surface of the fixing roller 1 is separated by the separation guide plate 7 and guided by a discharge guide 11 to be discharged to the outside of the device by a discharge roller 12.

The process speed is high such as 400 mm per second in the fixing device of the present embodiment, so that, when the successive fixing operation is performed wherein the sheet P is successively inserted to the nip section N, heat is taken from the sheet P and the unfixed toner image T (and further, heat is radiated from the pressure belt module). If the fixing belt 10 is configured only to be wrapped around the fixing roller 1, the surface temperature is liable to be lowered. There is a great limitation for making the heat reach its surface only by the heat supply from the inside of the fixing roller 1 by the halogen lamp 2, since the fixing roller 1 itself has some thickness.

In order to keep the surface temperature of the fixing roller 1 to the desired temperature, there arises a need to heat the fixing roller 1 from its inside with a higher temperature, which entails a fear of large energy loss, increased load upon designing the device and the occurrence of the fixing defect after that caused by the high surface temperature than needed after the end of the successive fixing operation.

Figure 7:
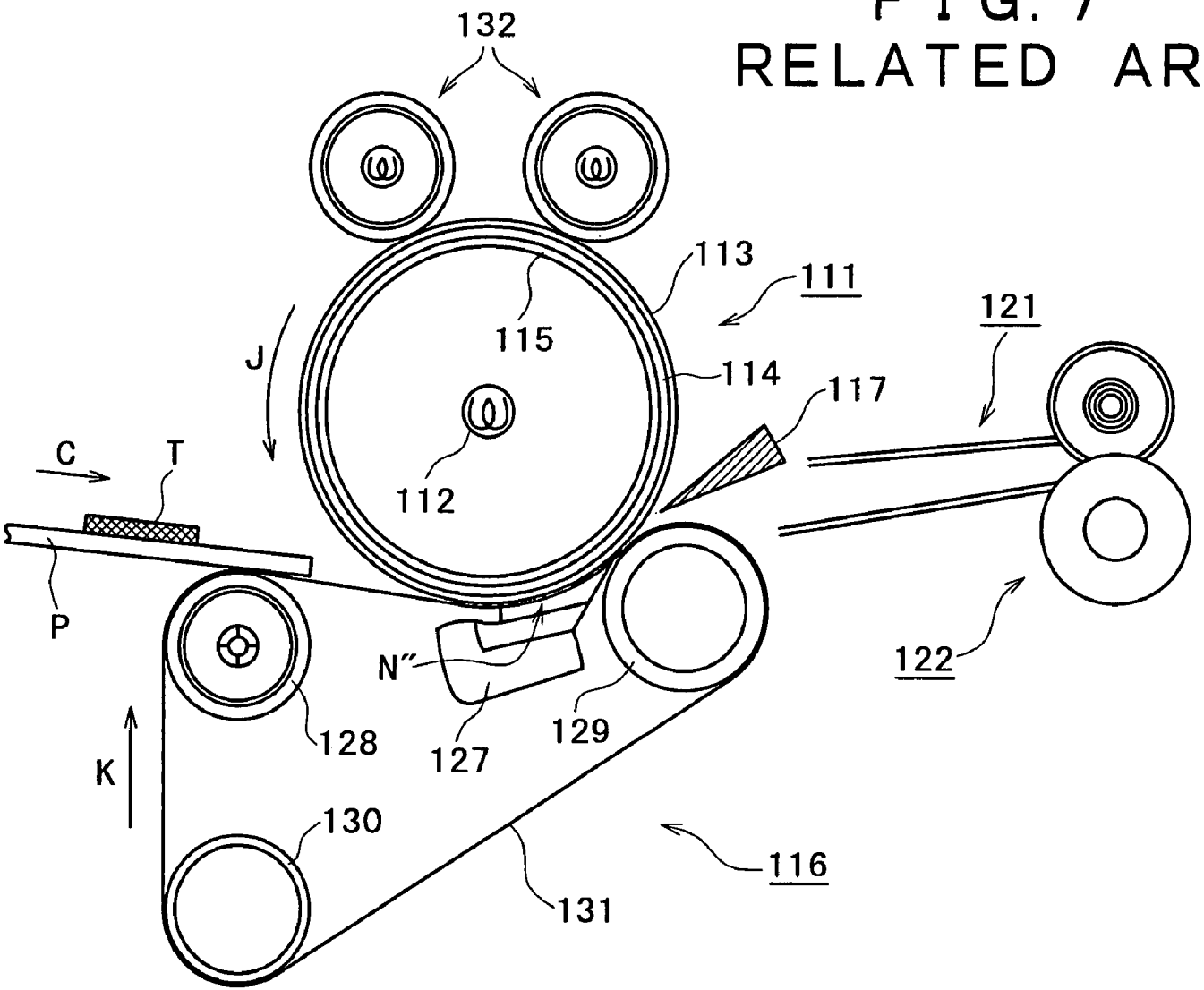
FIG. 7 RELATED ART
FIG. 7 is a cross-sectional view of a fixing device in which an external heating is further added to be used in the fixing device shown in FIG. 6.

Even if an external heating device for separately heating the surface of the fixing roller 1 is disposed like the above mentioned configuration shown in FIG. 7 as its countermeasure, a wide contact width between the external heating device (an external heating roller 132 in FIG. 7) and the surface of the fixing roller 1 cannot be obtained, whereby it is difficult to supply sufficient heat to the surface of the fixing roller 1.

On the other hand, this embodiment adopts the configuration wherein one layer is peeled from the fixing roller in the popular belt-nip fixing device, the peeled one being formed into an endless fixing belt 10 and being stretched by the tension roller 8, and wherein the fixing belt 10 corresponding to the surface section is heated, separate from the fixing roller 1, by the halogen lamp (heat source) 9 in the tension roller 8.

The fixing belt 10 has extremely small heat capacity compared to the entire fixing roller in the popular belt-nip fixing device. The section corresponding to the surface layer of the fixing roller in the configuration having only the fixing roller forms separately the fixing belt 10, this fixing belt 10 being heated independent of the remaining fixing roller 1, whereby time necessary for heating is easy to be assured and only the fixing belt 10 can effectively and rapidly be heated to a desired temperature, thereby being capable of implementing enhanced high-speed stability. Accordingly, the problem of the temperature droop that is a great subject upon the high-speed fixing is solved. In addition, even in the case where the fixing temperature is intended to be changed during the fixing operation (including both of up and down of the fixing temperature), only the temperature of the fixing belt 10 having small heat capacity is adjusted by the halogen lamp 9 via the tension roller 8, making it easy to change the fixing temperature to the desired one and further providing a rapid change.

Further, the outer surface of the tension roller 8 can be widely wrapped with the inner peripheral surface of the fixing belt 10, with the result that the arrangement of the halogen lamp 9 as a heat source in the tension roller 8 can secure a sufficient time for transmitting thermal energy from the heated tension roller 8 to the fixing belt 10, thereby being capable of effectively heating the fixing belt 10.

Additionally, an extension occurs on the inserted sheet at the high-pressure section that is a final stage of the nip section (the urging section by the pressure roller 19 in this embodiment) due to the distortion on the surface of the fixing roller in the popular belt-nip fixing device. However, the sheet P inserted to the nip section N is transported as its both surfaces are nipped between two belts (fixing belt 10 and pressure belt 21) that are free from "extension" in the fixing device of this embodiment, whereby the fear of the occurrence of the extension is wiped away.

As the other characteristic configuration of the present invention, the pressure belt 21 of the pressure belt module 16 is brought into contact with the outer peripheral surface of the fixing belt 10 only within the range of the section where the fixing belt 10 is wrapped around the surface of the fixing roller 1, thereby forming the nip section N for the fixing operation. Specifically, the fixing roller 1 is always positioned at the side of the inner peripheral surface of the fixing belt 10 at the nip section N, whereby the contact between the fixing belt 10 and the pressure belt 21 is firmly supported by the surface of the fixing roller 1, that is, it is not unstable like the contact between only belt and belt.

At the nip section N, moisture in the sheet P and the unfixed toner image T is rapidly heated to become water vapor. The water vapor is brought into a disturbing state in an unstable condition where the pressure (nip pressure) is relatively low like the configuration formed by only the belt-to-belt contact, so that there may be a case where an image defect (image disturbance and the like) is caused that disturbs the toner in the heat-fused unfixed toner image T. On the other hand, both belts are firmly supported on the surface of the fixing roller 1 at the entire area of the nip section N in this embodiment, thereby being capable of preventing the image defect (image disturbance and the like) due to the disturbance of the water vapor. In particular, the pressure pad (pressure member) 17 is arranged in this embodiment as shown in FIG. 1 for solving this problem, whereby the sheet P and the unfixed toner image T can firmly be supported by the fixing belt 10 and the pressure belt 21, thereby being capable of effectively preventing the disturbance of the water vapor.

Moreover, the unstable nip section formed only by the belt-to-belt contact hardly contributes to the image fixation. Heat is transmitted from the fixing belt to the pressure belt at this section, so that heat is greatly lost at this section. However, the fixing belt 10 is in contact with the pressure belt 21, as firmly supported by the surface of the fixing roller 1, only at the section where the pressure belt 21 is in contact with the unfixed toner image T in this embodiment. The whole nip section N is firmly supported by the surface of the fixing roller 1, thereby being free from useless thermal conduction, and hence, providing excellent thermal efficiency.

Figure 2:
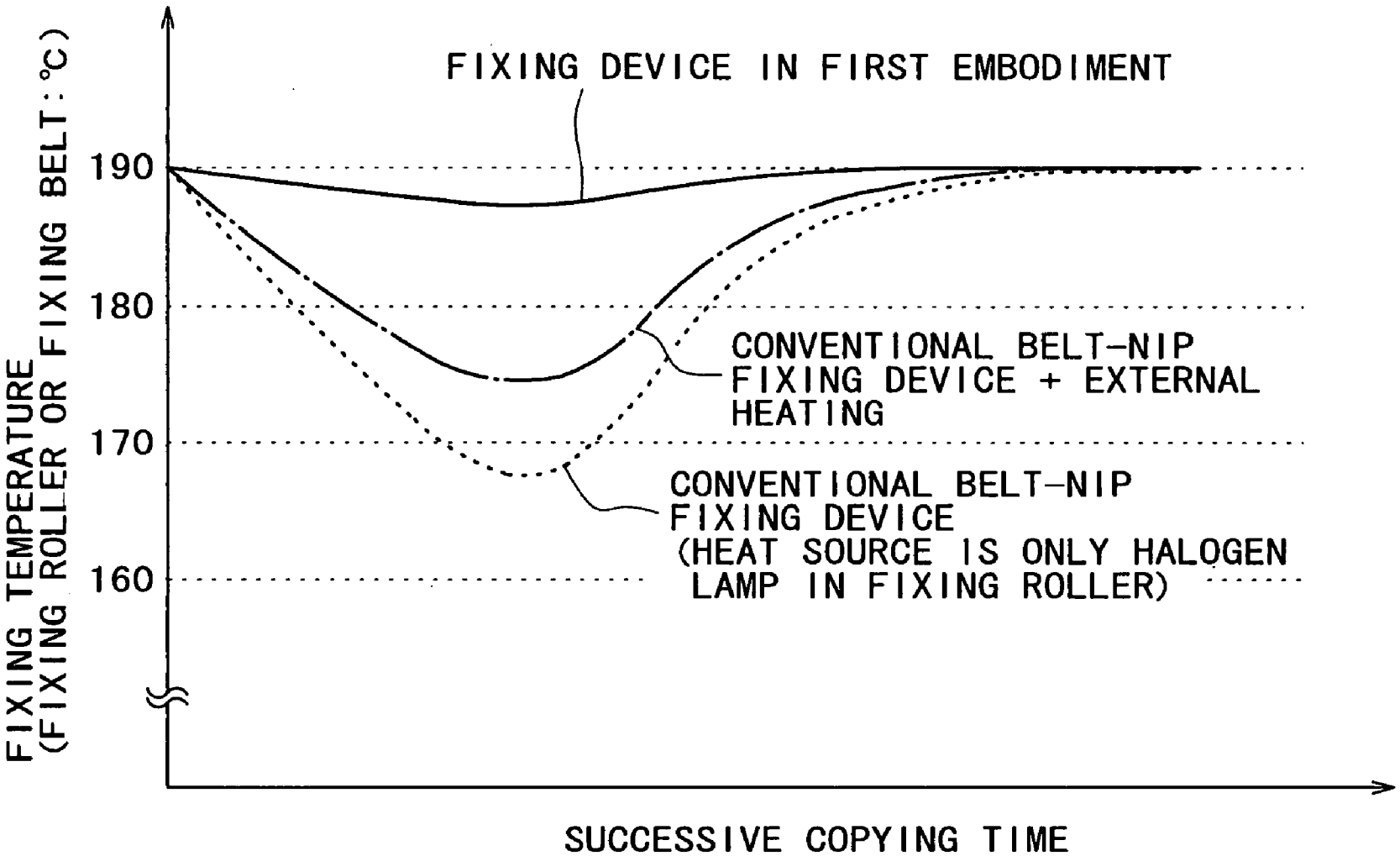
FIG. 2 is a graph showing a result obtained by confirming a change in a fixing temperature in the case where a sheet having an unfixed toner image formed thereon is successively fixed by use of the fixing device of the first embodiment and a conventional belt-nip fixing device.

FIG. 2 is a graph showing a result by confirming the change of the fixing temperature (the temperature on the surface of the fixing belt 10 in the fixing device of this embodiment, the temperature on the surface of the fixing roller in the conventional belt-nip fixing device: unit is ° C.) in the case where a sheet having an unfixed toner image formed thereon is successively fixed by use of the fixing device according to this embodiment and a conventional belt-nip fixing device. The horizontal axis represents a time of a successive copying, while the vertical axis represents a fixing temperature.

Figure 6:
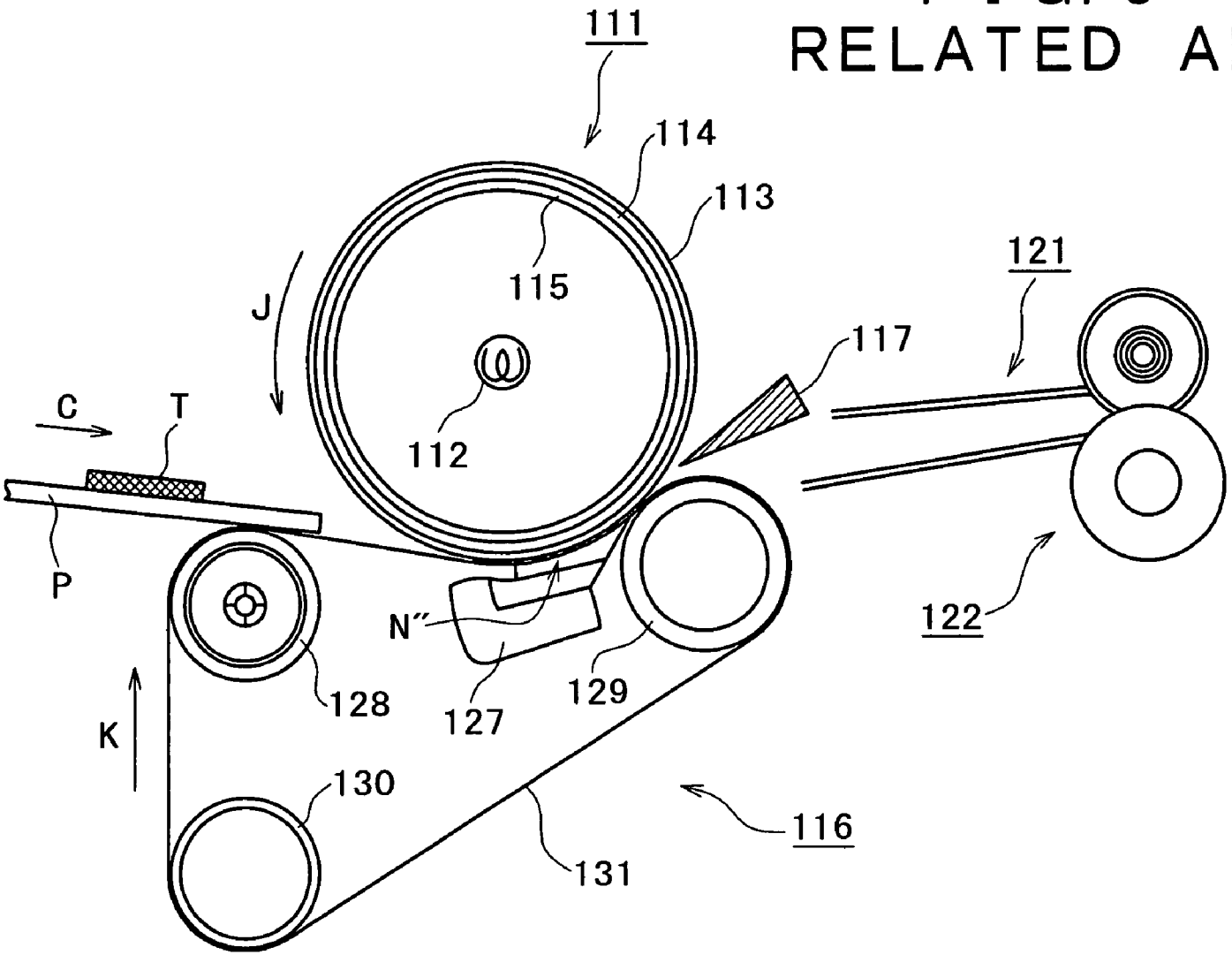
FIG. 6 RELATED ART
FIG. 6 is a cross-sectional view showing a fixing device that is one example of a conventional belt-nip fixing device.

For comparison, the change of the fixing temperature was confirmed about two types of the conventional belt-nip fixing device: the one wherein the heat source was only a halogen lamp in the fixing roller (the fixing device of FIG. 6), and the one wherein the external heater was provided in addition to the halogen lamp (the fixing device of FIG. 7). Further, various conditions of the device or sheet were made basically equal among three fixing devices. The phenomenon that the temperature is temporarily lowered, and then, recovered upon the successive copying occurs due to the following reason. Specifically, heat is rapidly deprived since the elastic layer around the fixing roller acts as a heat resistance at the beginning of the copying, and after that, the internal heat is supplied to appear on the surface, thereby recovering the surface temperature. Moreover, the temperature droop is further increased by the fact that much heat is deprived from the fixing roller since the non-heated tension roller in the pressure belt module becomes a heat load.

As understood from the graph shown in FIG. 2, the fixing temperature was lowered with the increase of the successive copying time in the conventional belt-nip fixing device, whereby the temperature droop was confirmed wherein the fixing temperature was lowered by 15 to 22° C. from the set fixing temperature (190° C.). The temperature droop was slightly eased but was still present to such a degree that it can affect high-speed fixability in the fixing device having the external heater.

On the other hand, the fixing temperature was little affected in the fixing device of this embodiment even if the successive copying time was increased, resulting in that the occurrence of the temperature droop was hardly observed.

As described above, this embodiment can solve the problem of the temperature droop, that is a great subject upon the high-speed fixation, as shown in the graph of FIG. 2.

<Second Embodiment>

Figure 3:
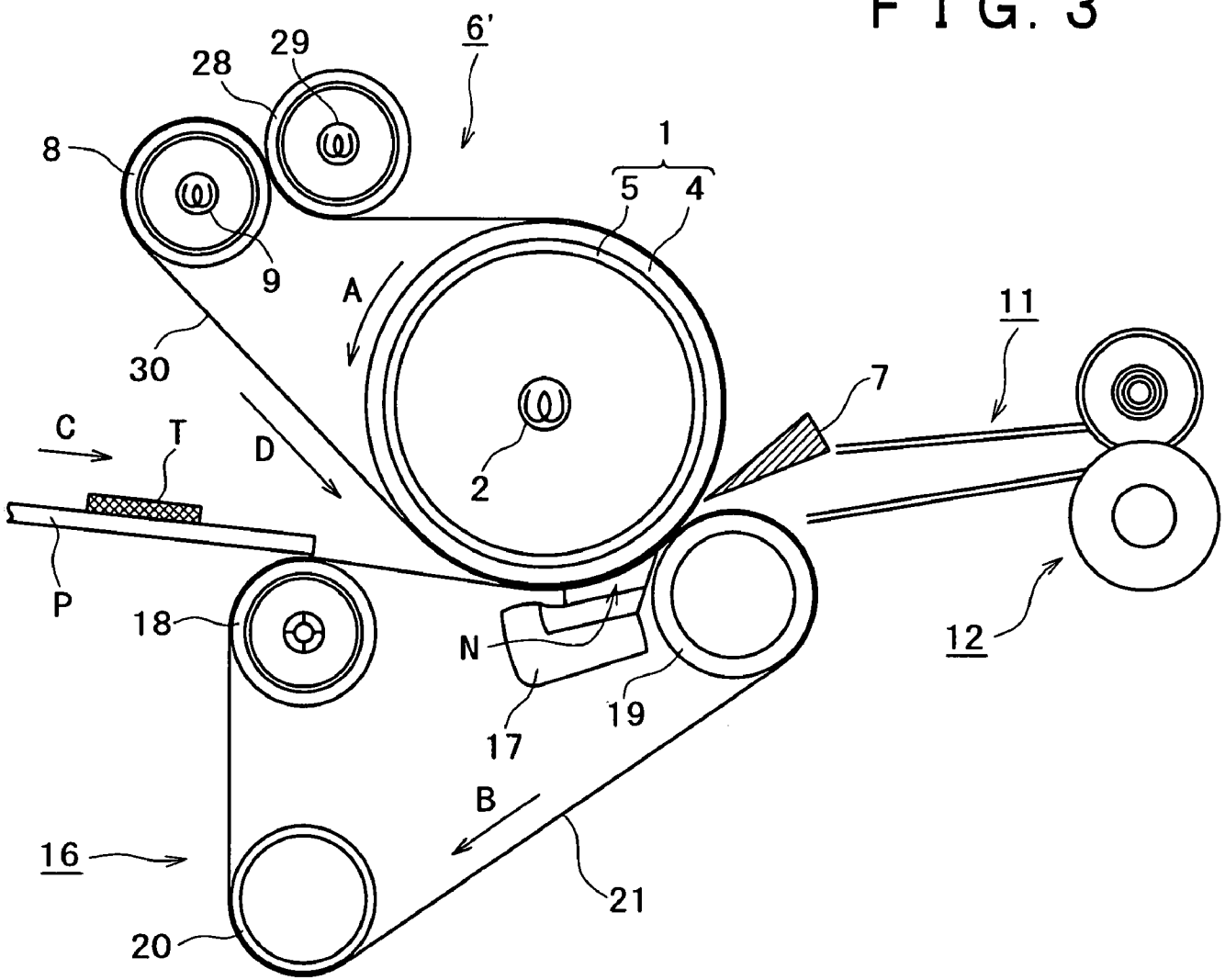
FIG. 3 is a cross-sectional view showing a fixing device of a second embodiment that is another example of the present invention.

Subsequently illustrated is a second embodiment as another example of the above mentioned embodiment A of the present invention. FIG. 3 a cross-sectional view of a fixing device according the second embodiment that is another example of the embodiment A (stretch-type) of the present invention. The fixing device of this embodiment is formed of a fixing belt module 6', the pressure belt module 16, the separation guide plate 7 and the discharge mechanisms (11, 12).

The fixing device of this embodiment has the same configuration as that of the fixing device of the first embodiment, except the configuration of the fixing belt module, i.e. except that two tension rollers are disposed and the stretching manner of the fixing belt is different according to the arrangement of two tension rollers. Therefore, members having the same function as the first embodiment are given by the same numerals as shown in FIG. 1 to thereby omit the detailed explanation thereof.

In this embodiment, the fixing belt module 6' is formed of the fixing roller 1 rotating in a direction shown by an arrow A, the tension roller (fixing-side tension roller) 8 having the halogen lamp 9 arranged therein as a heat source, a tension roller (fixing-side tension roller) 28 having similarly a halogen lamp 29 arranged therein as a heat source and a fixing belt 30 looped and stretched around the fixing roller 1, tension roller 8 and tension roller 28 for rotating in a direction shown by an arrow D with these rollers.

The fixing belt 30 is stretched around the fixing roller 1 whose inside is heated, the tension roller 8 and the tension roller 28 with a tension force of 10 kg. Specifically, the fixing belt 10 in the first embodiment is looped and stretched around the fixing roller 1 and the tension roller 8, while in this embodiment, the tension roller 28 is urged thereto from the outer peripheral surface of the fixing belt 30 and wrapped with some wrap angle (wrap angle of 80# and wrap length of 16 mm in this embodiment), with the result that the fixing belt 30 is looped and stretched around three rollers. Accordingly, the fixing roller 1 and the tension roller 8 are brought into contact with the inner peripheral surface of the fixing belt 30 and the tension roller 28 is brought into contact with the outer peripheral surface thereof. Note that the wrap angle of the tension roller 8 to the fixing belt 10 also becomes greater than that of the first embodiment due to the urging of the tension roller 28 (specifically, wrap angle of 230# and wrap length of 46 mm in this embodiment).

The fixing belt 30 is a flexible endless belt having a peripheral length of 330 mm and a width of 340 mm, having the same configuration as that in the first embodiment except for the stretching manner.

The tension roller 28 has a base material made of a stainless pipe roller having a diameter of 23 mm, thickness of 2 mm and length of 350 mm. A 20-μm thick PFA is coated on the surface of the base to form a release layer. This release layer is to prevent a slight offset toner or sheet particle from the surface of the fixing belt 30 from accumulating on the tension roller 28.

A halogen lamp of 800 W is inserted into the tension roller 28 as a heat source, whereby the surface of the tension roller 28 is controlled to have a temperature of 200° C. by a temperature sensor and a temperature controller not shown. Accordingly, the tension roller 28 has not only a function as a fixing-side tension roller but also a function of fixing belt heating unit. The halogen lamp 9 as a heat source is of course arranged also in the tension roller 8, so that the present embodiment has a configuration having two members functioning as the fixing belt heating unit.

It is to be noted that the tension roller 28 also has a function as a pressure roller for applying load such that the whole fixing belt 30 has tension force of 10 kg.

The specific state of the fixation to the sheet P by the fixing device of this embodiment will be explained.

The sheet P having the unfixed toner image T formed thereon is transported toward the nip section N (in a direction shown by an arrow C) from the left side in FIG. 3. The unfixed toner image T on the sheet P that is inserted to the nip section N is fixed by pressure and heat caused at the nip section N. Fixing by use of the fixing device of the present embodiment can assure stable fixability since a wide nip section can be obtained.

In this case, two types of heat is caused at the nip section N, i.e., given to the fixing belt 30; heat given by the halogen lamp 2 through the fixing roller 1, which is similar to the conventional case, and heat directly given to the fixing belt 30 by the tension rollers 8 and 28 heated by the halogen lamps 9 and 29 and serving as the fixing belt heating unit. Energy supply that cannot be provided only by the former heat can suitably and rapidly be supplied by the latter heat.

In the latter case wherein the tension rollers 8 and 28 are used as the fixing belt heating unit, in particular, the tension roller 8 that is in contact with the inner peripheral surface heats the fixing belt 30 from the side of the inner peripheral surface of the fixing belt 30, while the tension roller 28 that is in contact with the outer peripheral surface heats the fixing belt 30 from the side of the outer peripheral surface. As described above, the fixing belt 30 is heated from both of the inner peripheral surface and the outer peripheral surface in this embodiment, whereby even more heat is supplied in a stable manner. Consequently, the occurrence of the temperature droop can be suppressed extremely effectively, thereby further enhancing tolerance to the high-speed operation, and hence, further more high-speed fixation becomes possible.

The sheet P separated from the surface of the fixing roller 1 is separated by the separation guide plate 7 and guided by the discharge guide 11 to be discharged to the outside of the device by the discharge roller 12.

As described above, the fixing device of this embodiment has an effect of further suppressing the temperature droop and hence providing a high-speed fixation due to the fixing belt 30 heated from both of the inner and outer peripheral surfaces. This effect deserves special mention with respect to the fixing device of the first embodiment. The other operation and effect are the same as those of the first embodiment, so that the detailed explanation thereof is omitted.

<Third Embodiment>

Figure 4:
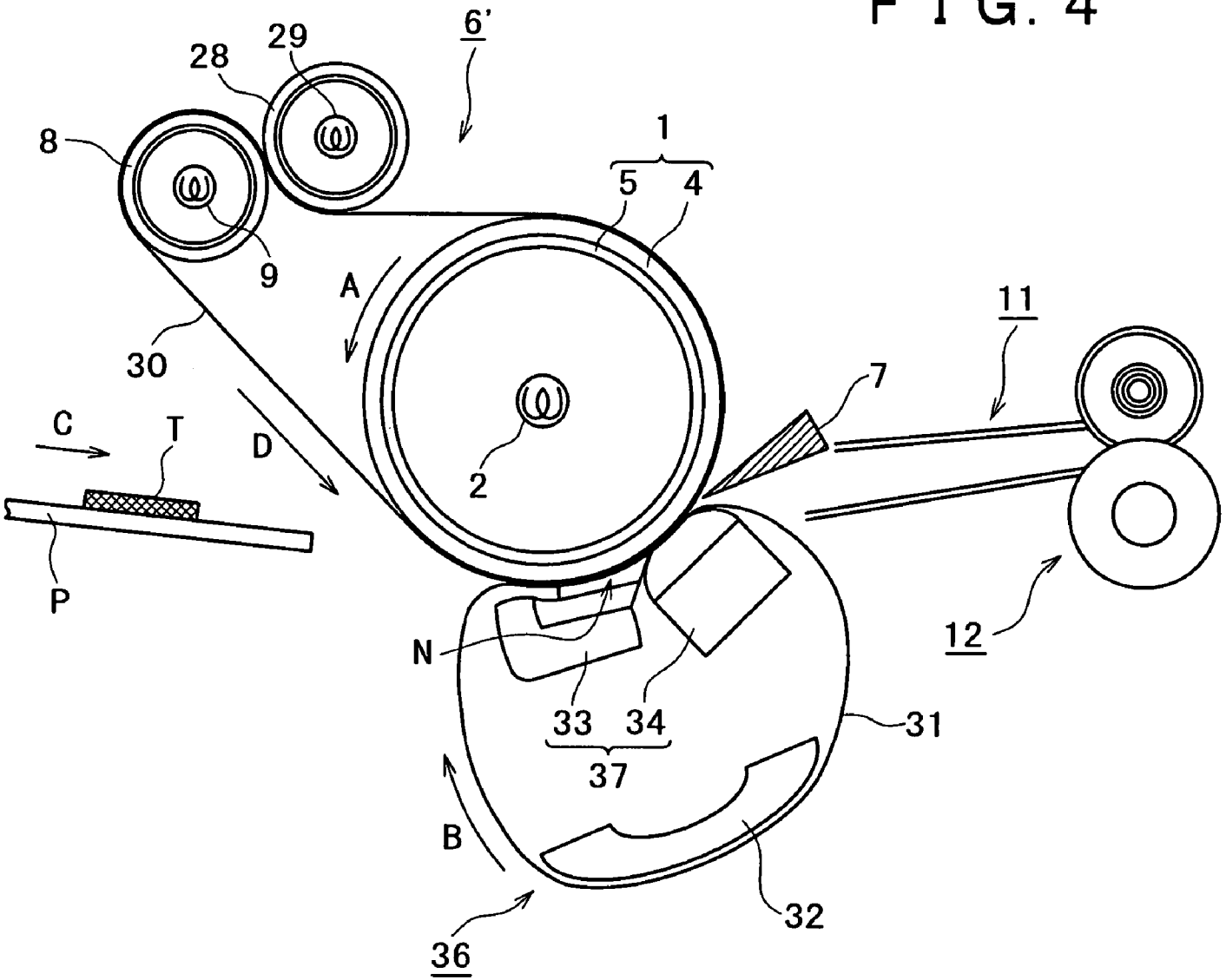
FIG. 4 is a cross-sectional view showing a fixing device of a third embodiment that is still another example of the present invention.
Figure 5:
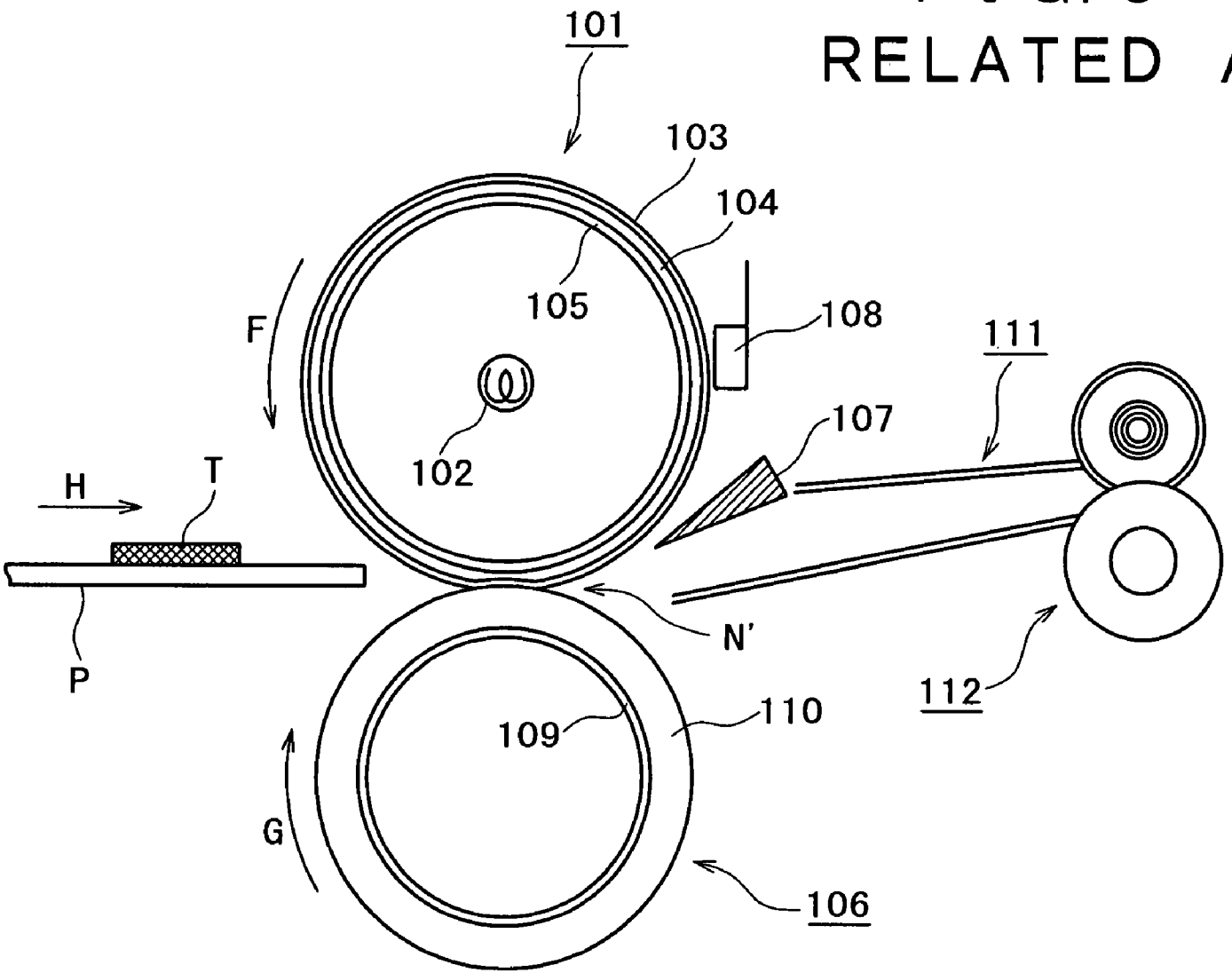
FIG. 5 RELATED ART
FIG. 5 is a cross-sectional view of a fixing device that is one example of a conventional roll-nip system (heat-pressure roller type)

Finally illustrated is a third embodiment as another example of the above mentioned embodiment B of the present invention. FIG. 4 is a cross-sectional view of a fixing device according the third embodiment that is another example of the embodiment B (free-belt-nip type) of the present invention. The fixing device of this embodiment is formed of the fixing belt module 6', a pressure belt module 36, the separation guide plate 7 and the discharge mechanisms (11, 12).

The fixing device of this embodiment has the same configuration as that of the fixing device of the second embodiment, except the configuration of the pressure belt module, i.e., except that the pressure belt freely rotates without being stretched around rollers, which is a so-called free-belt-nip system. Therefore, members having the same function as the second embodiment are given by the same numerals as shown in FIG. 3 to thereby omit the detailed explanation thereof.

In this embodiment, the pressure belt module 36 is formed of a pressure belt 31, a pressure member 37 arranged so as to be in contact with its inner periphery and a belt moving guide 32 provided so as to smoothly and slidably rotate the pressure belt 31.

The pressure belt 31 is pressed toward the fixing roller 1 by the pressure member 37 from its inner periphery and brought into contact with the outer peripheral surface of the fixing belt 30 wrapped around the fixing roller 1, so as to be wrapped with a predetermined angle (predetermined length), thereby forming a nip section N. The pressure belt 31 rotates in a direction shown by an arrow B with the rotation of the fixing belt 30 in a direction shown by an arrow D. The nip section N is formed at the region where the fixing belt 30 is wrapped around the fixing roller 1, whereby it seems as if the sheet P having the unfixed toner formed thereon were roller-fixed by the fixing roller 1 having the fixing belt 30 wrapped around its outer peripheral surface when the sheet P passes through the nip section N.

The basic structure of the pressure member 37 arranged at the inside of the pressure belt 31 is such that a pre-nip member 33 is disposed at the inlet side of the nip section N for ensuring a wide nip section while a separation nip member 34 is disposed at the outlet side of the nip section N for giving a distortion on the surface of the fixing roller 1. The pre-nip member 33 is made of the same material and has the same configuration as those of the pressure pad 17 in the first or second embodiment.

In this embodiment, a wide nip section is secured by the concave pre-nip member 33 that is approximately along the outer peripheral surface of the fixing roller 1 and the pressure of the fixing roller 1 is locally increased at the vicinity of the outlet of the nip section. N (hereinafter sometimes referred to as "separation nip section") by the separation nip member 34 that is projected with respect to the shape of the outer peripheral surface of the fixing roller 1. Locally increasing the pressure of the fixing roller 1 can afford high fixability with small total load compared to the case where the pressure is applied at the whole nip section like the roll-nip fixing device.

The material of the separation nip member 34 is not particularly limited, but it is preferable to use one that is difficult to be deformed, the examples of which include a heat-resistant resin such as PPS, polyimide, polyester, polyamide and the like or a metal such as iron, aluminum, stainless and the like. The shape of the separation nip member 34 is preferably formed into a convex curved surface in which its outer peripheral shape at the separation nip section has a constant curvature radius. The curvature radius may suitably be selected depending upon the radius, material, hardness and the like of the fixing roller 1.

The specific state of the fixation to the sheet P by the fixing device of this embodiment will be explained.

The sheet P having the unfixed toner image T formed thereon is transported toward the nip section N (in a direction shown by an arrow C) from the left side in FIG. 4. The unfixed toner image Ton the sheet P that is inserted to the nip section N is fixed by pressure and heat caused at the nip section N. Fixing by use of the fixing device of the present embodiment can assure stable fixability since a wide nip section can be obtained.

In this case, two types of heat is caused at the nip section N, i.e., given to the fixing belt 30; heat given by the halogen lamp 2 through the fixing roller 1 and heat directly given to the fixing belt 30 serving as the fixing belt heating unit, like the second embodiment. Energy supply that cannot be provided only by the former heat can suitably and rapidly be supplied by the latter heat. In the latter case wherein the tension rollers 8 and 28 are used as the fixing belt heating unit, in particular, the fixing belt 30 is heated from both of the inner peripheral surface and the outer peripheral surface in this embodiment, whereby even more heat is supplied in a stable manner. Consequently, the occurrence of the temperature droop can extremely effectively be suppressed, thereby further enhancing tolerance to the high-speed operation, and hence, further more high-speed fixation becomes possible.

Further, this embodiment adopts a free-belt-nip system, wherein the pressure belt 31 rotates in the direction B along the belt moving guide 32 without being looped and stretched. The tension roller is not required, thereby being capable of reducing heat capacity of the whole pressure belt module 36, and hence, the temperature droop can further be reduced.

The sheet P separated from the surface of the fixing roller 1 is separated by the separation guide plate 7 and guided by a discharge guide 11 to be discharged to the outside of the device by the discharge roller 12.

As described above, the fixing device of this embodiment has an effect of further more suppressing the temperature droop and hence providing a further high-speed fixation due to the fixing belt 30 heated from both of the inner and outer peripheral surfaces and the application of the free-belt-nip system. This effect deserves special mention with respect to the fixing device of the first embodiment. The other operation and effect are the same as those of the first embodiment, so that the detailed explanation thereof is omitted.

Although the fixing device of the present invention has been explained by taking up preferable embodiments, the present invention is not limited to the above mentioned embodiments. For example, the shape, material or size of each member or various conditions such as temperature or speed are illustrated only as one example. A person skilled in the art can give any modifications by a conventionally well-known knowledge or by an examination of setting any conditions suitable to the present invention if the configuration of the present invention is provided.

Moreover, although the case where only one or two tension rollers are provided for looping and stretching the fixing belt has been explained in the above mentioned embodiments, three tension rollers may be provided, and it is not always necessary to provide a heat source to all tension rollers. As for the heat source, it is not always necessary to dispose the heat source in the fixing-side tension roller. The fixing belt may directly be heated from outside by a heater and the like, for example. Further, the fixing belt or fixing-side tension roller may be heated by electromagnetic induction heating (IH).

Although three rollers of the reed roller 18, pressure roller 19 and tension roller 20 are used as the roller for looping and stretching the pressure belt in the first and second embodiments that are examples of the stretch-type fixing device, the number of the rollers is not limited to three. Two, four or more rollers may be used so long as they can stretch the pressure belt. In any case, it is required that two of the plural rollers have the function of the pressing-side tension roller and the function of the pressure roller.

Further, various configurations except for those specified as essential configurations in the present invention (fixing roller, fixing belt module including the fixing belt looped and stretched around the fixing roller and the fixing-side tension roller and the fixing belt heating unit and the pressure belt module) are only accompanying factors, so that these accompanying factors can be omitted or changed in the present invention. The accompanying factors that can be omitted or changed include, for example, the pressing member, separation guide plate, discharge mechanism and the like. It is needless to say that these elements are preferably included in the present invention.

[Image Forming Device]

The fixing device having the above mentioned configuration can be used for a conventionally well-known image forming device by an electrophotographic system. Specifically, it is an image forming device, by the electrophotographic system, including at least an unfixed toner image forming unit that adheres toner image-wise on a surface of a recording medium to form an unfixed toner image and a fixing unit that fixes the unfixed toner image carried on the surface of the recording medium by applying heat and pressure, wherein the fixing device having the configuration of the present invention is used as the fixing unit, whereby the temperature droop in the fixing device is eased to thereby provide a high-speed operation of the entire image forming device.

Examples of the unfixed toner image forming unit include one having an electrostatic latent image forming unit that forms an electrostatic latent image on an electrostatic latent image bearing member, a developing unit that develops the electrostatic latent image with toner and a transferring unit that transfers the obtained unfixed toner image onto a sheet-like recording medium.

Any configurations, that are conventionally well-known, can be used for other than the fixing device, so long as they are not departed from the scope of the present invention. Moreover, the separation device of the present invention maybe of course used for the elements other than the fixing device.

As apparent from the above, the present invention can provide a fixing device that can effectively reduce as much as possible the occurrence of the temperature droop even with a high speed, in order to implement a high-speed fixability at a higher level by a merit of a belt-nip fixing device, i.e., by assuring a wide nip. Accordingly, the present invention can provide a fixing device having many advantages such as high-speed, high-reliability, high image quality and the like compared to the conventional belt-nip system or roll-nip system. Consequently, the fixing device of the present invention can widely be utilized for an image forming device in an electrophotographic field or electrostatic recording field that is further desired to be operated with higher speed, thereby providing a great industrial applicability.

In any configuration, the fixing belt of the present invention provides extremely small heat capacity compared to the entire fixing roller in the case where the device is formed only by the fixing roller. In the present invention, the fixing belt is rapidly heated by the fixing belt heating unit at any sections other than the section where the fixing belt is wrapped around the outer periphery of the fixing roller. The section corresponding to the surface layer (or a part of or entire elastic layer) of the fixing roller in the configuration having only the fixing roller forms separately the fixing belt, this fixing belt being heated independent of the remaining fixing roller, whereby time necessary for heating is easy to be assured and only the fixing belt can effectively and rapidly be heated to a desired temperature, thereby being capable of effectively suppressing the occurrence of the temperature droop and implementing enhanced high-speed stability.

Further, in the present invention, the pressure belt of the pressure belt module is brought into contact with the outer peripheral surface of the fixing belt only within the range of the section where the fixing belt is wrapped around the surface of the fixing roller, thereby forming the nip section N for the fixing operation. Specifically, the fixing roller is always positioned at the side of the inner peripheral surface of the fixing belt at the nip section, whereby the contact between the fixing belt and the pressure belt is firmly supported by the surface of the fixing roller, that is, it is not unstable like the contact between only belt and belt.

As described above, both belts are firmly supported on the surface of the fixing roller at the nip section for fixation, thereby being capable of preventing the image defect (image disturbance and the like) due to the disturbance of water vapor caused by moisture contained in the recording medium or unfixed toner image inserted through the nip section. Moreover, the unstable nip section formed only by the belt-to-belt contact hardly contributes to the image fixation, so that heat is greatly lost at this section. However, the entire nip section for fixation is firmly supported by the surface of the fixing roller, thereby being free from useless thermal conduction, and hence, providing excellent thermal efficiency.

In the present invention, at least one of the fixing-side tension rollers in the fixing belt module has a heat source arranged therein for serving as the fixing belt heating unit.

The outer surface of the fixing-side tension roller can widely be wrapped with the inner peripheral surface or the outer peripheral surface of the fixing belt, so that time necessary for transmitting thermal energy from the heated tension roller to the fixing belt can sufficiently be assured by the arrangement of the heat source in the fixing-side tension roller, thereby being capable of effectively heating the fixing belt.

Moreover, the fixing belt has a thin layer compared to the fixing roller, so that it has extremely small heat capacity. Therefore, heat deprived by the toner and the recording medium at the nip section for fixation is supplied at the fixing-side tension roller having the heat source therein for serving as the fixing belt heating device, whereby its temperature is rapidly recovered to a set temperature. As described above, the fixing belt wrapped around both the fixing roller and the fixing-side tension roller (preferably at as wide a wrap angle as possible) is rapidly heated by heat conduction from both of the fixing roller and the fixing-side tension roller, both insides being heated.

Therefore, a necessary heat quantity can always be supplied in a stable manner even if a thick sheet having great heat capacity is fixed with high speed, since a thermal response is excellent. This can solve the problem of the temperature droop that is a great subject upon the high-speed fixation.

In the present invention, two or more fixing-side tension rollers are provided, wherein the fixing belt is wrapped such that at least one roller of two or more fixing-side rollers is brought into contact with the outer peripheral surface of the fixing belt, and this roller has a heat source arranged therein for serving as the fixing belt heating unit.

In the case where the belt is stretched by plural rollers, in general, each roller is arranged in the periphery of the belt, or in the case where the belt is stretched by three or more rollers, some of all rollers (MAX, number of all rollers minus 2. For example, all rollers are three, one roller.) can be arranged so as to press the belt from the outer periphery of the belt. In the case of this arrangement, i.e., in the case where two or more fixing-side tension rollers are provided (a state in which the belt is stretched by three or more rollers including the fixing roller) and the fixing belt is wrapped such that one roller of them is brought into contact with the outer peripheral surface of the fixing belt, the fixing-side tension roller that is brought into contact with the outer peripheral surface of the fixing belt has a heat source arranged therein as the fixing belt heating unit for serving as the fixing belt heating unit, whereby the outer peripheral surface of the fixing belt can be heated.

When the heat source as the fixing belt heating unit is also arranged in the other fixing-side tension rollers that are brought into contact with the inner peripheral surface of the fixing belt, the fixing belt is heated from both of the outer peripheral surface and the inner peripheral surface, thereby being capable of supplying much heat quantity in a stable manner, and hence, a further high-speed fixation becomes possible.

The fixing device of the present invention can be classified into two embodiments depending upon the configuration of the pressure belt module, i.e., classified into an embodiment A wherein the present invention is applied to the configuration that the pressure belt is stretched (hereinafter sometime simply referred to as "stretch-type") and an embodiment B wherein the present invention is applied to the configuration that the pressure belt has a configuration of a so-called free-belt-nip system. Specific descriptions are made as follows.

(Embodiment A)

An embodiment wherein:

the pressure belt module further includes a pressure roller and one or more pressing-side tension rollers, and the pressure belt rotates as stretched by the rollers;

the pressure roller is urged toward the surface of the fixing roller via the pressure belt and the fixing belt; and a predetermined length of the pressure belt toward an upstream side in its rotating direction from a section of the pressure belt that is urged toward the surface of the fixing roller by the pressure roller is pressed and wrapped around the outer peripheral surface of the fixing belt at the section wrapped around the fixing roller, thereby forming a nip section for fixation between the fixing belt and the pressure belt.

In this embodiment A, the nip section for fixation is preferably formed at the upstream side of the fixing belt within the range of the section around which the fixing belt is wrapped. Forming the nip section for fixation is formed at the upstream side in the rotating direction of the fixing belt can prevent the decrease in the temperature of the fixing belt that is caused for the reason that the heat of the fixing belt heated by the tension roller is deprived by the fixing roller before entering the nip section.

In this embodiment A, the pressure belt module preferably includes a pressure member that is urged toward the surface of the fixing roller via the pressure belt from the upstream side of the pressure roller in the rotating direction of the pressure belt and from the inner periphery of the pressure belt.

In this embodiment A, the formed nip section has at least two pressure sections: a low-pressure section at the inlet side of the nip section and a high-pressure section at the outlet side of the nip section. If any members for pressing are not provided, pressure is given only by the tension from the fixing belt, but it is difficult to obtain nip pressure required for the fixation with this state. The insufficient pressure at the low-pressure section can be supplemented by providing the pressure member, thereby being capable of further enhancing the fixability. Further, the arrangement of the pressure member can prevent the pressure belt from being loosed from the surface of the fixing roller at the low-pressure section, thereby being capable of preventing the possibility of the occurrence of the defect such as a fixing defect, image disturbance and transporting defect.

The pressure member maybe formed into a roller-shape or pad-shape, but it is preferable that the pressure member is formed into a pad-shape.

In this embodiment A, at least one of the pressing-side tension rollers is preferably provided with a belt edge position detecting mechanism for detecting a position of a belt edge of the pressure belt now rotating and a shaft shifting mechanism for shifting a position where the belt is in contact in a shaft direction of the roller according to a detected result of the belt edge detecting mechanism, in order to ensure stable movement of the pressure belt.

(Embodiment B)

An embodiment wherein the pressure belt module further includes a pad-shaped pressure member that is arranged so as to be in contact with the inner periphery of the pressure belt that is in a free state without being stretched, wherein the pressure member is urged toward the surface of the fixing roller via the pressure belt and the fixing belt and a predetermined length of the pressure belt is pressed and wrapped around the outer peripheral surface of the fixing belt at the section wrapped around the outer periphery of the fixing roller, thereby forming the nip section for fixation between the fixing belt and the pressure belt.

In this embodiment B, the nip section for fixation is preferably formed at the upstream side in a rotating direction of the fixing belt within the range of the section around which the fixing belt is wrapped.

Further, in this embodiment B, nip pressure of the pressure member for pressing the fixing roller is desirably locally increased at the vicinity of an outlet of the nip section. Locally increasing the nip pressure of the pressure member for pressing the fixing roller at the vicinity of the outlet of the nip section locally increases the pressure of the fixing roller, whereby high fixability can be obtained with reduced load compared to the case where the pressure is generated at the entire nip section.

In this embodiment B, it is preferable that a belt edge guide for controlling a shift of the pressure belt in a shaft direction of a rotational shaft is disposed at the pressure belt module.

Moreover, it is preferable that, in the fixing device in the embodiment A or B of the present invention, at least one of the pressing-side tension rollers is preferably provided with a belt edge position detecting mechanism of the fixing belt and a shaft shifting mechanism for shifting a position where the fixing belt is in contact in the shaft direction of the roller according to the detected result of the belt edge detecting mechanism, in order to ensure stable movement of the pressure belt.

On the other hand, an image forming device of the present invention is characterized by including at least an unfixed toner image forming unit that adheres toner image-wise on a surface of a recording medium to form an unfixed toner image and a fixing unit that fixes the unfixed toner image carried on the surface of the recording medium by applying heat and pressure, wherein the fixing device according to one of the claims is used as the fixing unit.

In order to implement high-speed fixability at a higher level by a merit of a belt-nip fixing device, i.e., by assuring a wide nip, the fixing device of the present invention adopts a so-called two-belt system by adding the fixing belt stretched between the fixing roller and the other rollers in the configuration at the side of the fixing roller in the conventional belt-nip system, and further, sufficient energy can be supplied to the nip section by heating the fixing belt with the fixing belt heating device at a position apart from the fixing roller. Accordingly, the present invention can provide a fixing unit that can reduce as much as possible the occurrence of the temperature droop even with a high speed. Moreover, the present invention can provide an image forming device including this fixing device, thereby being capable of providing even faster image formation.

The entire disclosure of Japanese Patent Application No. 2003-308972 filed on Sep. 1, 2003 including specification, claims, drawings and abstract is incorporated herein by reference in its entirety.

What is claimed is:

1. A fixing device comprising:

a fixing belt module composed of a fixing roller having a heat source, two or more tension rollers at a fixing side and an endless fixing belt looped and stretched around the fixing roller and tension rollers to thereby rotate; and a pressure belt module including an endless pressure belt that comes in contact with an outer peripheral surface of the fixing belt only within a range of a section where the fixing belt is wrapped around a surface of the fixing roller, thereby forming a nip section for fixation between itself and the fixing belt, wherein the fixing belt module includes a fixing belt heating unit that comprises at least two of the tension rollers that have respective heat sources, at least one of the tension rollers with the heat source heating by contact an inner peripheral surface of the fixing belt and at least one of the tension rollers with the heat source heating by contact an outer peripheral surface of the fixing belt at any sections other than the section where the fixing belt is wrapped around the outer peripheral surface of the fixing roller.

2. The fixing device according to claim 1, wherein the fixing roller has at least an elastic layer formed on the peripheral surface of a cylindrical member.

3. The fixing device according to claim 1, wherein the pressure belt module further includes a pressure roller and one or more pressing-side tension rollers, and the pressure belt rotates as stretched by the rollers;

the pressure roller is urged toward the surface of the fixing roller via the pressure belt and the fixing belt; and a predetermined length of the pressure belt toward an upstream side in its rotating direction from a section of the pressure belt that is urged toward the surface of the fixing roller by the pressure roller is pressed and wrapped around the outer peripheral surface of the fixing belt at the section wrapped around the fixing roller, thereby forming a nip section for fixation between the fixing belt and the pressure belt.

4. The fixing device according to claim 3, wherein the nip section for fixation is preferably formed at the upstream side of the fixing belt within the range of the section around which the fixing belt is wrapped.

5. The fixing device according to claim 3, wherein the pressure belt module includes a pressure member that is urged toward the surface of the fixing roller via the pressure belt from an inner periphery of the pressure belt and at an upstream side in a rotating direction of the pressure belt with respect to the pressure roller.

6. The fixing device according to claim 5, wherein the pressure member is formed into a pad shape.

7. The fixing device according to claim 1, wherein the pressure belt module further includes a pad-shaped pressure member that is arranged so as to be in contact with the inner periphery of the pressure belt that is in a free state without being stretched, wherein the pressure member is urged toward the surface of the fixing roller via the pressure belt and the fixing belt and a predetermined length of the pressure belt is pressed and wrapped around the outer peripheral surface of the fixing belt at the section wrapped around the outer periphery of the fixing roller, thereby forming the nip section for fixation between the fixing belt and the pressure belt.

8. The fixing device according to claim 7, wherein the nip section for fixation is preferably formed at the upstream side in a rotating direction of the fixing belt within the range of the section around which the fixing belt is wrapped.

9. The fixing device according to claim 7, wherein nip pressure of the pressure member for pressing the fixing roller is locally increased at the vicinity of an outlet of the nip section.

10. The fixing device according to claim 9, wherein the fixing roller has at least an elastic layer formed on the peripheral surface of the cylindrical member, and the elastic layer formed on the fixing roller has deformation due to the urging of the pressure member toward the surface of the fixing roller.

11. An image forming device comprising:

at least an unfixed toner image forming unit that adheres toner image-wise on a surface of a recording medium to form an unfixed toner image and a fixing unit that fixes the unfixed toner image carried on the surface of the recording medium by applying heat and pressure, wherein the fixing unit having a fixing belt module composed of a fixing roller having a heat source, two or more tension rollers at a fixing side and an endless fixing belt looped and stretched around the fixing roller and tension rollers to thereby rotate; and a pressure belt module including an endless pressure belt that comes in contact with an outer peripheral surface of the fixing belt only within a range of a section where the fixing belt is wrapped around a surface of the fixing roller, thereby forming a nip section for fixation between itself and the fixing belt, wherein the fixing belt module includes a fixing belt heating unit that comprises at least two of the tension rollers that have respective heat sources, at least one of the tension rollers with the heat source heating by contact an inner peripheral surface of the fixing belt and at least one of the tension rollers with the heat source heating by contact an outer peripheral surface of the fixing belt at any sections other than the section where the fixing belt is wrapped around the outer peripheral surface of the fixing roller.

* * * * *